United States Patent [19]

Olson et al.

[11] 4,426,008

[45] Jan. 17, 1984

[54] STORAGE SYSTEM FOR CANNED GOODS

[75] Inventors: Ralph B. Olson, Lombard; Stuart I. Musick, Highland Park, both of Ill.

[73] Assignee: Amco Corporation, Chicago, Ill.

[21] Appl. No.: 211,908

[22] Filed: Dec. 1, 1980

[51] Int. Cl.[3] ..... A47F 1/00

[52] U.S. Cl. ..... 211/49 D; 211/194; 312/45; 312/72

[58] Field of Search ..... 211/49 D, 181, 188, 211/194; 312/45, 42, 72

[56] References Cited

U.S. PATENT DOCUMENTS

| | | | |
|---|---|---|---|
| 388,251 | 8/1888 | Bower . | |
| 1,383,318 | 7/1921 | McCormick . | |
| 1,905,180 | 4/1933 | Lowther . | |
| 2,382,191 | 8/1945 | Weichselbaum | 312/45 |
| 2,564,552 | 8/1951 | Verdery, Jr. | 312/94 |
| 2,915,162 | 12/1959 | Umstead | 193/27 |
| 2,969,152 | 1/1961 | Hennion | 211/49 D |
| 3,055,293 | 9/1962 | Lariccia | 101/44 |
| 3,203,553 | 8/1965 | Pendergrast et al. | 211/49 D |
| 3,203,554 | 8/1965 | Pendergrast, Jr. et al. | 211/49 |
| 3,318,455 | 5/1967 | Takahashi | 211/49 |
| 3,393,797 | 7/1968 | Flood | 206/56 |
| 3,393,808 | 7/1968 | Chirchill | 211/49 |
| 3,404,927 | 10/1968 | Mellion | 312/45 |
| 3,606,022 | 9/1971 | Beesley | 211/49 D |
| 3,784,022 | 1/1974 | Beesley, Jr. | 211/49 |
| 3,805,964 | 4/1974 | Titus | 211/49 D |
| 3,970,199 | 7/1976 | Marschak | 211/128 |
| 4,015,885 | 4/1977 | Baggaley | 312/42 |
| 4,092,055 | 5/1978 | Wullenwaber | 312/45 |
| 4,226,193 | 10/1980 | Gindel | 211/181 X |

FOREIGN PATENT DOCUMENTS

| | | | |
|---|---|---|---|
| 1294347 | 4/1962 | France | 108/111 |

*Primary Examiner*—Ramon S. Britts
*Assistant Examiner*—Robert W. Gibson, Jr.

[57] ABSTRACT

A gravity-feed system for storing and dispensing canned goods on a "first-in, first-out" basis is provided. The system comprises an upper track assembly which is supported by an upright frame and is inclined downwardly from the front to the back of the frame. The upper track assembly includes at least one track adapted to receive a number of cans disposed on their sides. The track has an aperture at its lower end to enable the cans to drop from the track. A lower track assembly is positioned below the first track assembly and is supported by the upright frame. The lower track assembly is inclined downwardly from the back to the front of the frame and includes at least one track corresponding to the track of the upper assembly which is adapted to receive the cans dropping from the track of the upper assembly. Guide means are provided to insure that the cans remain aligned as they move from the upper track to the lower track.

8 Claims, 7 Drawing Figures

STORAGE SYSTEM FOR CANNED GOODS

BACKGROUND OF THE INVENTION

This invention relates to systems for storing canned goods and more particularly, to gravity-feed systems and devices for storing and dispensing canned goods in a plurality of adjacent pairs of vertical tracks which form an integral, stackable unit.

In restaurants and institutions such as hospitals and dormitories where large inventories of canned goods must be kept on hand for use in preparing meals, storage of such canned goods often presents a troublesome problem. Cans stored on shelves or in boxes are usually stacked on top of and in front of each other and therefore, are often not readily accessible for use. Storing canned goods in this manner also makes it difficult to keep a current check on inventory since many cans are not in full view. In addition, as the canned goods are taken from storage and new cans added to the inventory the cans must be continually restacked, wasting valuable time. Moreover, storage of canned goods on shelves, in boxes or by stacking on the floor often takes up more space than actually needed and presents an unsightly appearance.

In an effort to solve these problems, a standard vertical storage rack has been developed that is used throughout the food services industry. The standard rack is a metal unit comprising a number of inclined tracks disposed in vertical columns with three to four columns across.

The tracks of a typical unit are formed by pairs of angle guides attached to the frame. Each track can accommodate about six No. 10 size cans, which constitute one case. As the cans are dispensed from a track the remaining cans roll down the inclined track to the front of the rack.

These commonly known storage racks range from about three feet to seven feet in height and three or more feet in depth. They cannot, however, be broken down into smaller units to accommodate different sized and shaped storage spaces. As a result, the prior art racks are not adaptable to many different storage needs.

The canned goods may be loaded on the typical prior art storage rack from the front or back of the rack. Loading from the back of the rack is easier than from the front, since gravity causes the cans to roll down the tracks to the front of the rack as they are loaded. Loading from the back of the rack, however, is not always possible since the racks are sometimes placed back-to-back, or with their backs adjacent to a wall or some other object. In such instances, the cans must be loaded from the front of the rack. This requires that the cans be pushed up the tracks against gravity as they are loaded in series. As five or six cans are loaded on each track, a person must push an increasing load up the track which eventually amounts to about thirty or forty pounds. Thus, the storage areas in which prior art racks may be placed are limited if it is desired to be able to load the racks by the more convenient method from the back.

It is desirable when storing canned goods to be able to remove and store the contents of an entire case at one time. This eliminates wasting space by retaining partially filled cases and is more efficient. To hold one case (six cans) of No. 10 size canned goods (No. 10 size cans are widely used by institutions which must prepare food in quantity at each serving) on each track, the prior art storage racks have been designed three feet or more in depth. As a result, they cannot be conveniently used on standard counters and shelving which are usually about two feet deep.

Another disadvantage of prior art storage racks is that they are relatively expensive to manufacture because of their complexity and also are expensive to ship to users because of their cumbersome size and weight.

Accordingly, an object of this invention is to provide a device for storing and dispensing canned goods which is economical and efficient to manufacture and ship to users.

Another object of this invention is to provide a storage system for canned goods which readily loads and dispenses the canned goods from the front of the system.

A further object of this invention is to provide a storage system for canned goods which is adaptable to fit in storage spaces of varying heights.

Yet another object of this invention is to provide a storage system for canned goods which fits on standard shelving and countertops. Another object is to provide a device which will dispense one case (six cans) of No. 10 cans from a single pair of vertical tracks.

Still a further object of the invention is to provide a storage system for canned goods which is as strong as, but lighter in weight than, prior art devices and can easily be assembled and disassembled.

Further objects will become manifest from the description, drawings and claims.

SUMMARY OF THE INVENTION

In keeping with one aspect of the invention, a storage system consisting of one or more stackable units is provided. Each stackable unit comprises upper and lower track assemblies adapted to hold a plurality of cans disposed on their sides. The track assemblies are supported by an upright frame. The upper track assembly is inclined downwardly from the front of the frame to the back and each track of the assembly has an aperture formed at its lower end to enable a can to drop from the track to a corresponding track in the lower track assembly. The lower track assembly is inclined downwardly from the back of the frame to the front. Because of the incline of the tracks, a can placed in the upper track will roll toward the back of the frame, drop through the aperture at the lower end of the track to the corresponding track below, and then roll toward the front of the frame. Cans can thus be loaded into the system by placing them in the upper track assembly until each track in both assemblies is fully loaded. To insure that the cans remain properly aligned in the tracks, guides are provided adjacent the track apertures. The guides have upwardly tapered fittings which engage the cans as they fall through the apertures.

DESCRIPTION OF THE PREFERRED EMBODIMENT

Figure 1:
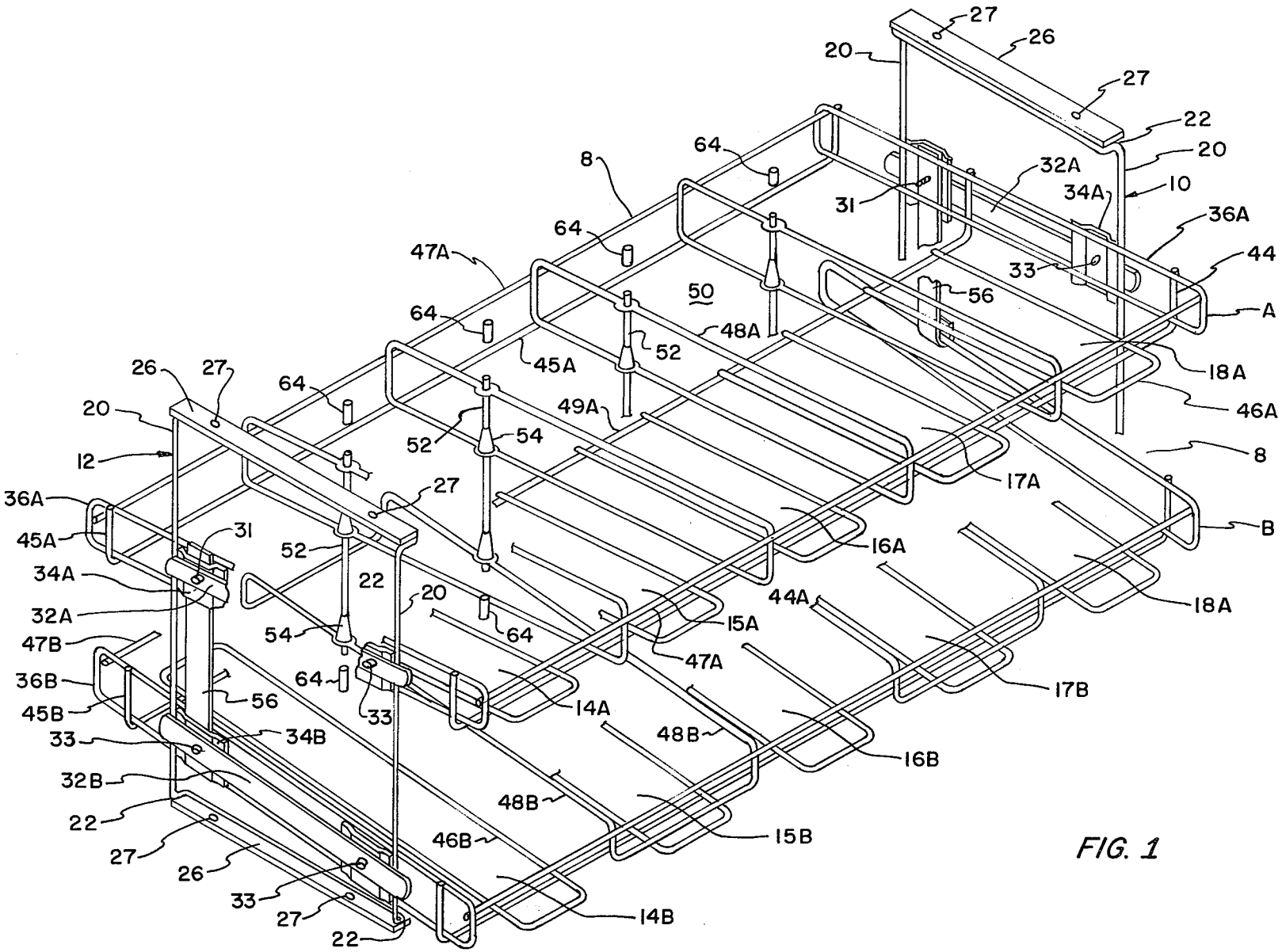
FIG. 1 is a perspective view of one embodiment of this invention with portions broken away.

As shown in FIG. 1, a single stackable unit 8 of the invention comprises an upper track assembly A and a lower track assembly B which are vertically spaced apart and extend between upright supports 10 and 12. The two assemblies together form five vertical pairs of tracks 14A, 14B; 15A, 15B; 16A, 16B; 17A, 17B; and 18A, 18B for the storage of canned goods. Each stackable unit of the storage system is substantially the same.

Figure 2:
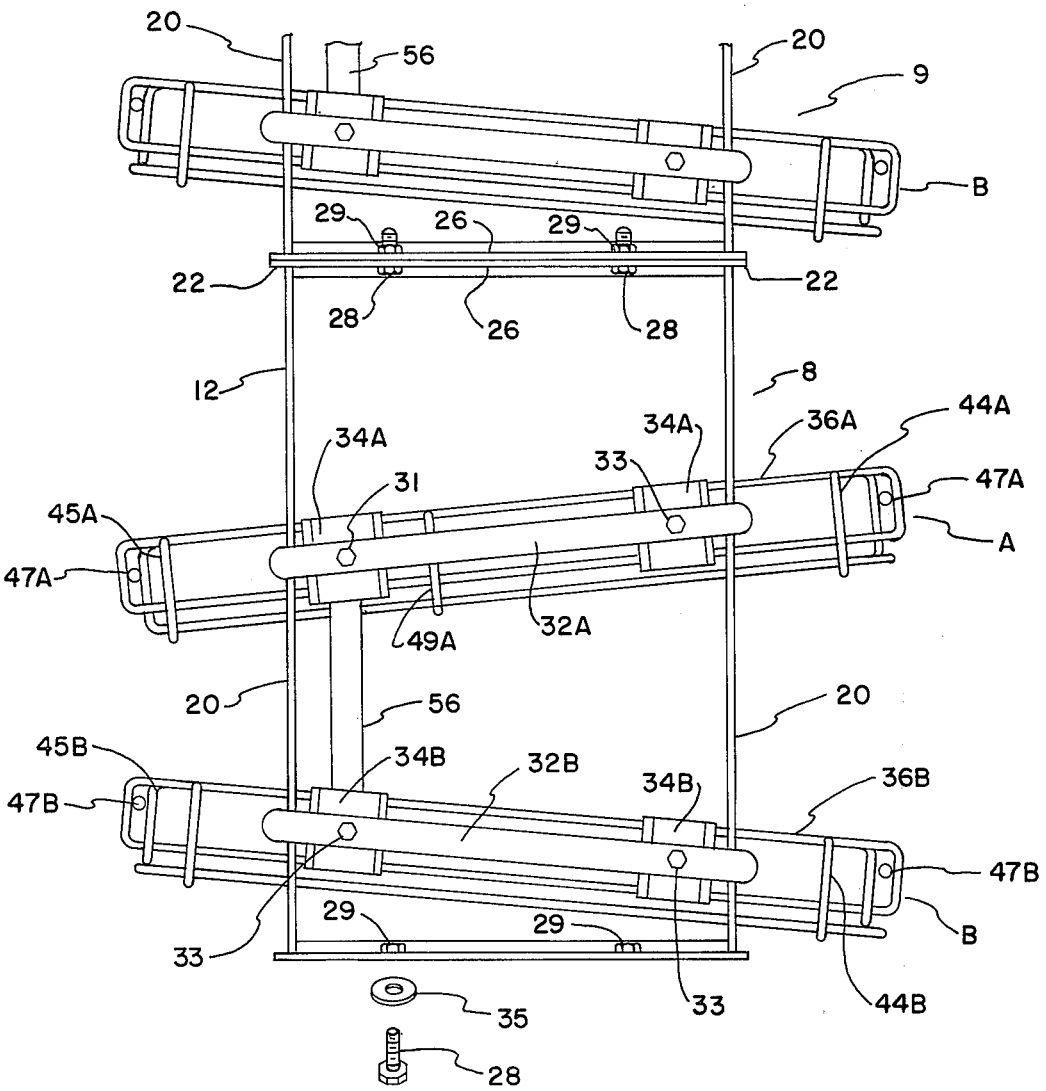
FIG. 2 is a side elevational view of the embodiment of FIG. 1, showing the embodiment of FIG. 1 with means added to the bottom to connect it to a countertop and with a second stackable unit shown in a fragmentary view connected to the top.

Standards 20 of upright supports 10 and 12 are bent perpendicular to the plane formed by the standards at points 22 to support plates 26. The upper plate 26 is provided with a pair of spaced-apart apertures 27 to receive bolts 28. As shown in FIG. 2, the upper plates 26 of unit 8 cooperate with the lower plates 26 of unit 9 to enable the two units to be stacked and securely fastened together by means of bolts 28 to form a two-unit storage system. Additional units may be further stacked on units 8 and 9 to increase the storage capacity of the system. The lower plates 26 of unit 8 enable the unit to be securely fastened to a countertop, shelf, or other support by means of weld nuts 29 which are an integral part of lower plate 26 and are adapted to receive bolts 28. The weld nuts 29 may be square, hexagonal, round, oblong or any other suitable shape. This permits a plurality of units to be stacked together to accommodate various sized storage spaces and to increase storage capacity. Where the unit is to be connected to a wire shelf, a large washer 35 can be used (see FIG. 2). For ease of assemly and simplicity, bolts 28, 31, and 33 may be identical. While particular methods of fastening the unit to a support or to one another are shown, other methods may be used where desirable.

Mounting members 32A and 32B extend between standards 20 to attach track assemblies A and B, respectively, to upright supports 10 and 12 as best shown in FIG. 2. Members 32A extend downwardly at an angle to the vertical axis of standards 20 from the front of the system to the back to provide the proper angle of inclination for track assembly A. Members 32B extend downwardly at an angle to the vertical axis of standards 20 from the back to the front of the system to provide the proper angle of inclination for track assembly B. Each track assembly slopes about 1½ inches downward from its upper end to insure that the cans loaded in the system roll smoothly along the tracks. At this angle of inclination even dented cans roll smoothly.

Figure 3:
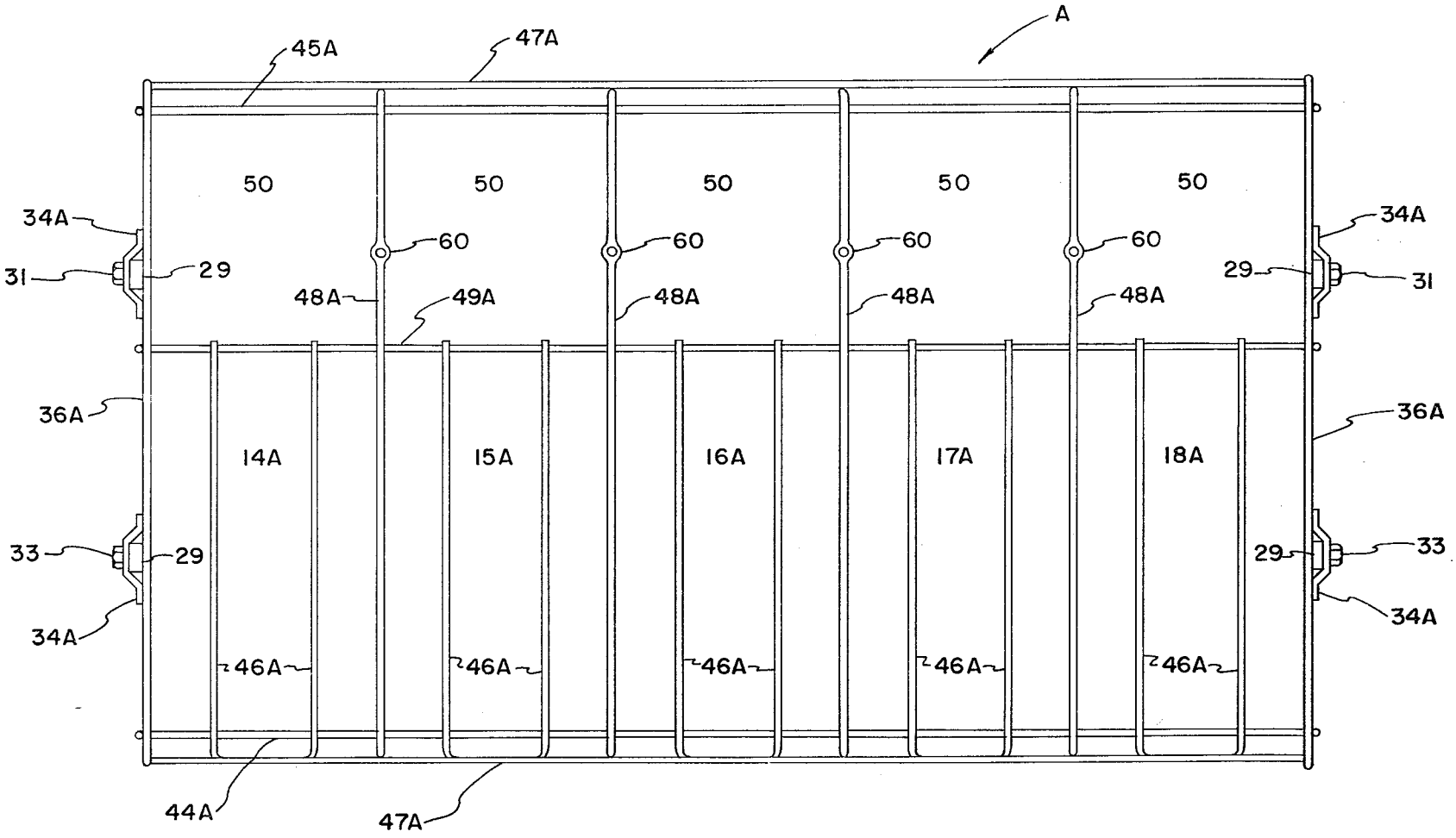
FIG. 3 is a plan view of the upper track assembly forming a part of the embodiment of FIG. 1.

FIG. 3 shows track assembly A. Brackets 34A are disposed on side frames 36A of track assembly A for attaching it to mounting plates 32A by means of bolts 31 and 33. The entire storage unit can be quickly and easily assembled by only eight bolts. Because assembling the storage unit is simple and requires only a pliers or wrench, the units can be shipped to customers disassembled. This saves shipping space and costs and provides an important advantage over prior art storage racks.

Members 44A and 49A (FIG. 3) extend between side frames 36A to support U-shaped rails 46A. Members 44A, 45A, 47A, and 49A support lateral members or dividers 48A. The dividers 48A extend perpendicularly upward from the plane of the rails 46A and are laterally spaced apart to accommodate the length of the particular sized can to be stored in the system. The dividers 48A separate pairs of rails 46A which form the tracks 14A, 15A, 16A, 17A and 18A. The cans rest on the tracks between the dividers 48A. If desired, the dividers and rails may be spaced at different intervals to accommodate different sized cans. In addition, the number of tracks in each track assembly may be varied to accommodate particular storage space requirements and needs of different users.

Figure 4:
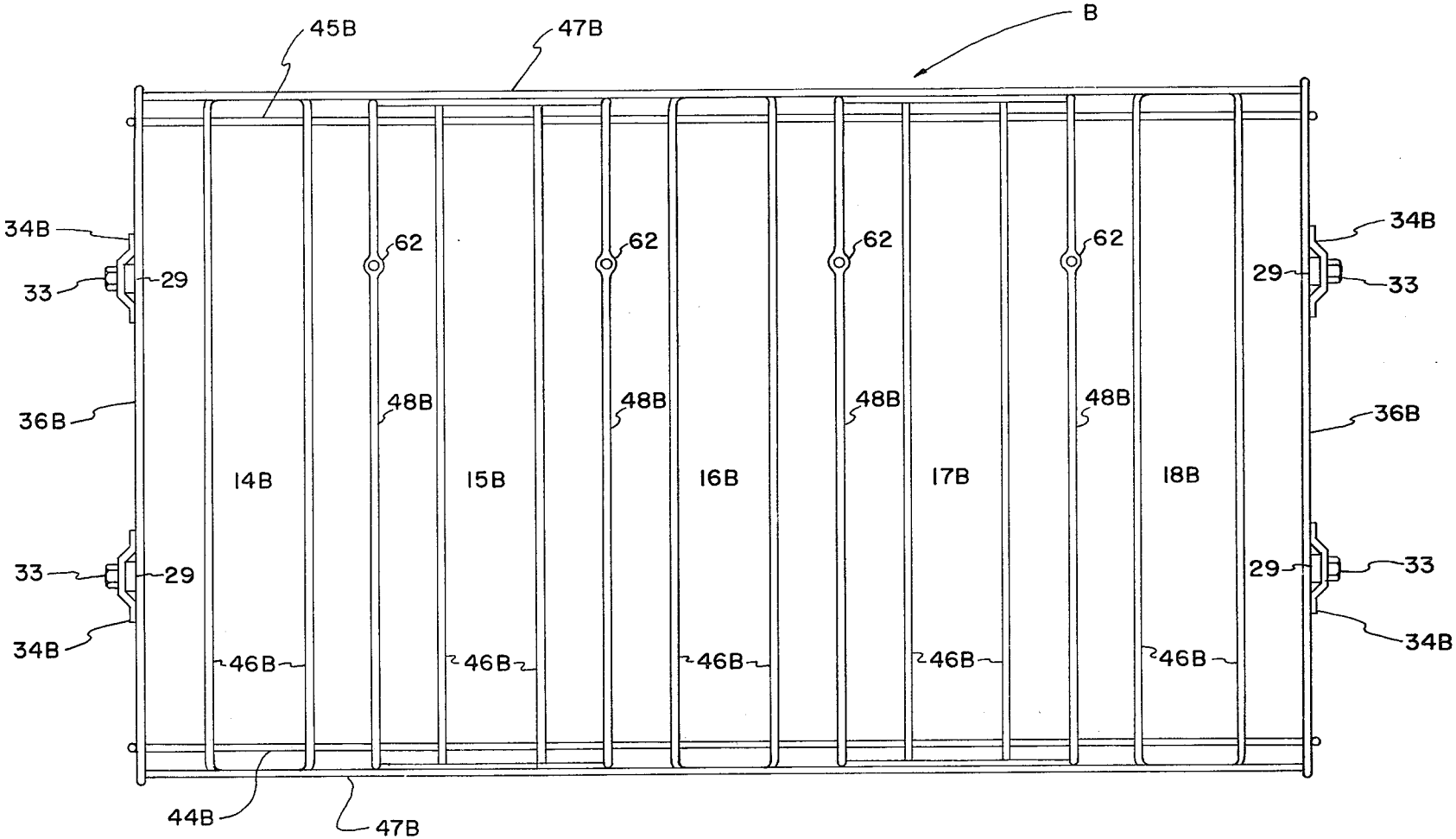
FIG. 4 is a plan view of the lower track assembly forming a part of the embodiment of FIG. 1.

The rails 46A in upper track assembly A extend only about two-thirds of the depth of the track assembly to support member 49A thereby forming openings 50 at the back of the tracks through which cans loaded on the upper tracks 14A, 15A, 16A, 17A and 18A will drop down to the corresponding lower tracks 14B, 15B, 16B, 17B and 18B in the lower track assembly B shown in FIG. 4. The rails 46B on the lower track assembly B extend the entire depth of the assembly and are attached to members 44B and 45B. The dividers 48B are attached to and supported by members 44B, 45B, and 47B. Preferably, the support members, rails and dividers are constructed of lightweight metal rods, but other suitable materials and forms may be used where desired.

Because the frame and track assemblies of the storage system are formed from lightweight metal rods rather than the metal angles and tubular sections used in prior art racks, each unit 8 and 9 is relatively lightweight as compared to the prior art devices, making them easier to handle. Nevertheless, the construction of each unit of the system provides enough strength to support the heavy cans it is designed to hold. The upper track assembly of the unit 8 must be able to support about 90 pounds when fully loaded and also absorb the impact from cans dropping onto the upper track assembly as they are loaded. The lower track assembly must likewise be able to support about 90 pounds and absorb the impact from cans dropping from the upper track assembly.

Figure 5:
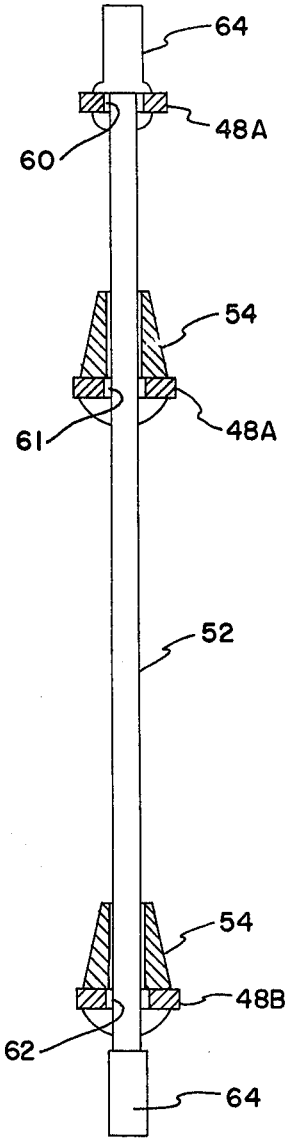
FIG. 5 is a fragmentary side elevational view of a guide means used in the embodiment of FIG. 1.

Referring to FIGS. 1, 3 and 5, rods 52 extend downwardly through openings 60 and 61 (FIGS. 3 and 5) in dividers 48A on the upper track assembly A to the dividers 48B on the lower assembly B. The rods 52 connect to the dividers 48B by means of openings 62 therein (FIG. 4). Flattened portions are provided in dividers 48A and 48B at the points where the openings 60, 61 and 62 are provided. Cups 64 function to retain the rods 52 in position. The rods 52 function to keep the cans aligned with the lower tracks 14B, 15B, 16B, 17B and 18B as they drop through the apertures 50 of the upper tracks. To prevent the cans from catching on the dividers 48A, 48B and getting stuck between upper assembly A and lower assembly B as they drop through the apertures 50, rods 52 are provided with tapered bushings 54, preferably constructed from nylon, resting adjacent the bottom of dividers 48A and the top of dividers 48B. The bushings 54 taper outwardly from the top to the bottom where they are approximately equal to the diameter of the dividers 48A and 48B (FIG. 5). The tapered bushings 54 thus guide the edges of the cans dropping through openings 50 away from the dividers. The same result can also be achieved by tapering the portion of the guide rods 52 adjacent the dividers 48A and 48B instead of using bushings 54.

As shown in FIGS. 1 and 2, guide members 56 extend downwardly from side frames 36A to side frames 36B to guide the cans dropping through openings 50 in the pair of outermost tracks 14A, 14B and 18A, 18B. The guide members 56 are J-shaped straps as shown in FIG. 1. They are hooked over the top portion of each side frame 36B and secured by the bolt 31 to side frame 36A. The members 56 prevent the edges of the cans dropping through openings 50 from catching on the side frame 36B (FIGS. 1 and 2).

While the size of the tracks of the storage system can be constructed to accommodate different sized cans, the illustrated and described system relates to No. 10 size cans, which are widely used by restaurants and the like. An entire case (six cans) of No. 10 size cans can be stored by a single pair of vertical tracks.

Figure 6:
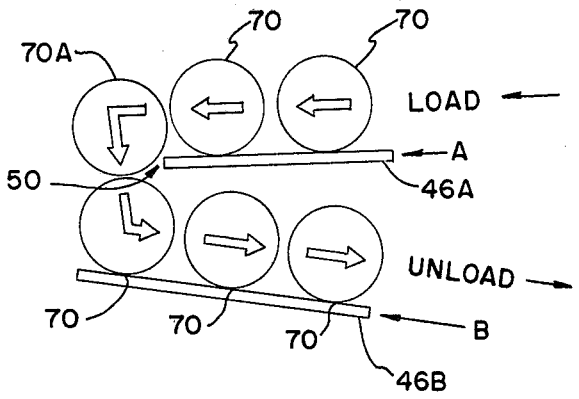
FIG. 6 is a schematic view showing the manner in which the cans are stored and unloaded from the embodiment of FIG. 1.

A schematic view of the operation of the unit is shown in FIG. 6. The cans 70 to be stored in the storage system are placed on their sides into one of the tracks in upper assembly A. The cans 70 are preferably introduced into the front of the track assembly, which is on the right side of FIGS. 1, 2 and 6. The first three cans will roll down the track on rails 46A toward the back (the left side of FIGS. 1 and 6) of the system and drop through the openings 50 to the corresponding track in lower assembly B where they come to rest. The remaining three cans 70 will be held in the track in upper assembly A, with one can 70A resting in opening 50 on top of a can in the lower assembly.

As shown in FIG. 6, the cans are dispensed from the inventive system on a "first-in, first-out basis". When the first can loaded in the storage system is dispensed from the lower assembly, the remaining cans in the lower assembly roll forward and create a space for the can resting in opening 50 to drop down from the upper assembly. The cans remaining in the upper track roll downward toward opening 50 with one can resting in the opening. As the cans are dispensed from the lower assembly, additional cans may be placed in the upper assembly if desired.

Because the inventive system utilizes a pair of corresponding tracks to store canned goods rather than a single track as in the prior art devices, the depth of each unit 8 and 9 of the storage system is about one-half that of the prior art devices. As a result, unlike prior art devices, the storage system can easily fit on standard counters and shelving.

Figure 7:
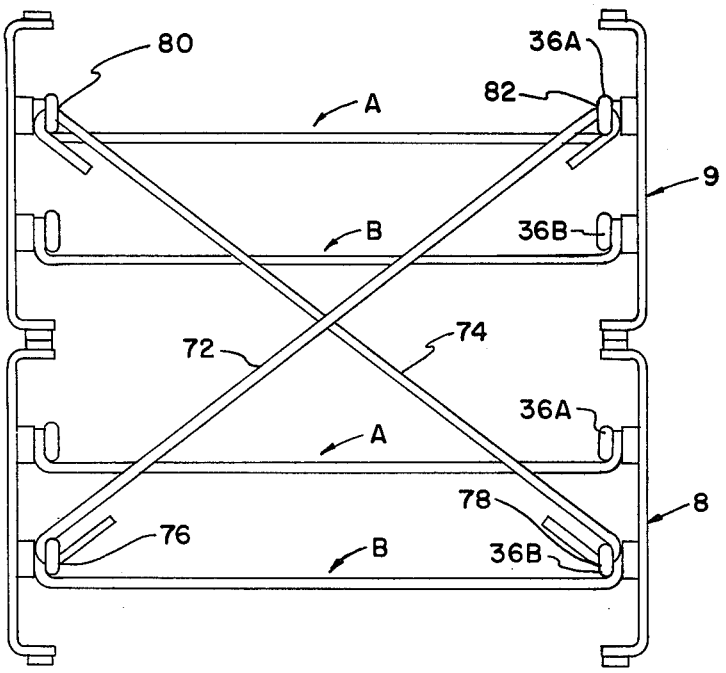
FIG. 7 is a schematic view taken from the rear of the embodiment of this invention where two units are stacked with braces attached to preclude swaying.

As shown in FIG. 7, braces 72 and 74 can be added to the rear of the units 8 and 9 to prevent swaying and thereby improve the stability of the unit. They are diagonally secured to corners of the rear of the unit, as shown in FIG. 7. The braces 72 and 74 are preferably constructed of wire with hooked ends. They are criss crossed so that each is hooked opposite the other (at points 76 and 78) to the top of the bottom side frame 36B of unit 8 and hooked opposite the other (at points 80 and 82) to the bottom of the top side frame 36A of unit 9.

While specific embodiments of this invention have been shown, modifications thereof may be made which fall within the spirit and scope of this invention. The appended claims are, therefore, intended to cover any such modifications, as well as the embodiments specifically disclosed herein.

I claim:

1. An article for storing and dispensing canned goods comprising two opposed upright supports; a plurality of adjacent downwardly inclined upper tracks mounted on the supports and adapted to receive a plurality of cans disposed on their sides, said tracks having apertures at their lower ends to enable the cans to drop through the tracks; a plurality of adjacent lower tracks mounted on the upright supports corresponding to and disposed below the upper tracks, said lower tracks being inclined downwardly in a direction opposite to the incline of the upper tracks and adapted to receive the cans dropping through the apertures of the upper tracks; each upper and lower track formed by a pair of rails which supports the cans and lateral members disposed perpendicular to the plane of said rails between each pair of said rails; and means for aligning the cans in the tracks as they fall through the apertures of the upper tracks, said means being positioned adjacent said apertures of the upper tracks and extending from the lateral members of the upper tracks to the lateral members of the lower tracks; said aligning means including a guide adjacent the bottom of the lateral members for the upper tracks and adjacent the top of the lateral members for the lower tracks for preventing the lateral members from interfering with the cans as they fall through the apertures of the upper tracks onto the lower tracks.

2. The article of claim 1 wherein the guide is an upwardly tapered bushing.

3. A storage and dispensing system for canned goods comprising an upright frame; an upper track assembly attached to the frame and having a plurality of tracks, said track assembly being inclined downwardly from the front of the frame to the back and adapted to receive a plurality of cans disposed on their sides, the tracks having apertures formed at their lower ends to enable said cans to drop from the tracks; a lower track assembly attached to the frame and having a plurality of tracks corresponding to and disposed directly below the upper tracks, said lower track assembly being inclined downwardly from the back of the frame to the front of the frame, the lower tracks being adapted to receive the cans which drop from the upper tracks, wherein the upper and lower tracks are formed by a plurality of rails and a plurality of lateral members disposed between at least some of the rails; means adjacent said upper track apertures for guiding the movement of said cans from the upper tracks to the lower tracks; said guide means including tapered bushings adjacent the bottom of said lateral members located on the upper assembly and adjacent the top of the lateral members located on said lower assembly.

4. The system of claim 3 wherein said upright frame includes upper and lower means for attaching said frame to countertops and the like and to other frames.

5. The system of claim 4 wherein the attaching means comprises a plate having apertures and fasteners adapted to be inserted in the apertures.

6. The system of claim 4 wherein the lower attaching means comprises a plate having weld nuts integrally formed therewith, said nuts being adapted to receive bolts.

7. An article for storing and dispensing canned goods comprising two opposed upright supports; at least one downwardly inclined upper track mounted on the supports and adapted to receive a plurality of cans disposed on their sides, said track having an aperture at its lower end to enable the cans to drop through the track; a lower track mounted on the upright supports and disposed below the upper track, said lower track being inclined downwardly in a direction opposite to the incline of the upper track and adapted to receive the cans dropping through the aperture of the upper track, each upper and lower track being formed by a pair of rails which supports the cans and by lateral members disposed perpendicular to the plane of said rails between each pair of said rails; and means for aligning the cans in the tracks as they fall through the apertures of the upper tracks, said means being positioned adjacent said apertures of the upper tracks and extending from the lateral members of the upper tracks to the lateral members of the lower tracks, the aligning means including J-shaped straps attached to the upper and lower tracks adjacent the upright supports.

8. The article of claim 7 wherein the aligning means include tapered bushings adjacent the bottom of the lateral members for the upper tracks and adjacent the top of the lateral members for the lower tracks.

* * * * *